US009676581B2

(12) United States Patent
Okawa

(10) Patent No.: US 9,676,581 B2
(45) Date of Patent: Jun. 13, 2017

(54) SHEET STACKING APPARATUS, SHEET PROCESSING APPARATUS, AND IMAGE FORMING APPARATUS

(71) Applicant: CANON KABUSHIKI KAISHA, Tokyo (JP)

(72) Inventor: Yuichiro Okawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/091,477

(22) Filed: Apr. 5, 2016

(65) Prior Publication Data

US 2016/0304308 A1 Oct. 20, 2016

(30) Foreign Application Priority Data

Apr. 17, 2015 (JP) ..... 2015-085303

(51) Int. Cl.
*B65H 29/12* (2006.01)
*B65H 29/14* (2006.01)
(Continued)

(52) U.S. Cl.
CPC ..... *B65H 29/125* (2013.01); *B65H 29/14* (2013.01); *B65H 31/02* (2013.01); *B65H 31/24* (2013.01); *B65H 31/3018* (2013.01); *B65H 31/38* (2013.01); *B65H 2301/163* (2013.01); *B65H 2301/4212* (2013.01); *B65H 2301/4213* (2013.01); *B65H 2405/1111* (2013.01); *B65H 2405/11151* (2013.01); *B65H 2405/324* (2013.01); *B65H 2405/3311* (2013.01);
(Continued)

(58) Field of Classification Search
CPC .... B65H 29/12; B65H 29/34; B65H 31/3009; B65H 31/3018; B65H 31/32; B65H 31/34; B65H 2408/12; B65H 2801/24; B65H 29/125; B65H 29/14; B65H 31/02; B65H 31/24; B65H 31/38
USPC ..... 271/207, 213, 220
See application file for complete search history.

(56) References Cited

U.S. PATENT DOCUMENTS 6,231,039 B1 * 5/2001 Chung ..... B42C 1/12 270/58.01
6,997,456 B2 * 2/2006 Fukatsu ..... G03G 15/6538 270/58.08
(Continued)

FOREIGN PATENT DOCUMENTS

JP 2007290861 A 11/2007
JP 2014-019569 A 2/2014

*Primary Examiner* — David H Bollinger
(74) *Attorney, Agent, or Firm* — Canon U.S.A., Inc. IP Division

(57) ABSTRACT

A sheet stacking apparatus includes a conveying unit, a first support member configured to support a sheet, the first support member including a first supporting surface contacting an underside of a first end portion of the sheet in a direction orthogonal to a sheet conveying direction, a second support member configured to support the sheet, the second support member including a second supporting surface contacting an underside of a second end portion of the sheet, and a stacking unit. At least one of the first support member and the second support member is capable of moving between a first position that supports the sheet and a second position that does not support the sheet, and a length of the first support member is shorter than a length of the second support member in the sheet conveying direction.

18 Claims, 12 Drawing Sheets

(51) Int. Cl.

| | |
|---|---|
| ***B65H 31/02*** | (2006.01) |
| ***B65H 31/24*** | (2006.01) |
| ***B65H 31/30*** | (2006.01) |
| ***B65H 31/38*** | (2006.01) |

(52) U.S. Cl.
CPC ..... *B65H 2601/325* (2013.01); *B65H 2701/18292* (2013.01); *B65H 2801/06* (2013.01)

(56) References Cited

U.S. PATENT DOCUMENTS

| | | | | |
|---|---|---|---|---|
| 7,630,681 | B2 * | 12/2009 | Kuwata | G03G 15/6538 271/207 |
| 7,748,704 | B2 * | 7/2010 | Terao | B42C 1/12 270/58.11 |
| 2003/0057625 | A1 * | 3/2003 | Kuwata | B42C 1/12 270/58.02 |
| 2004/0104528 | A1 * | 6/2004 | Fukatsu | B42C 1/12 271/207 |
| 2006/0255524 | A1 * | 11/2006 | Isobe | B42C 1/12 270/58.08 |
| 2008/0179821 | A1 * | 7/2008 | Sekiyama | B65H 31/24 271/158 |
| 2009/0026696 | A1 * | 1/2009 | Ogata | B42C 1/125 271/220 |
| 2009/0146369 | A1 * | 6/2009 | Yoshimura | B65H 31/18 271/207 |
| 2011/0024973 | A1 * | 2/2011 | Sekiyama | B65H 31/02 271/185 |
| 2015/0266694 | A1 * | 9/2015 | Abe | G03G 15/6541 271/220 |

* cited by examiner

SHEET STACKING APPARATUS, SHEET PROCESSING APPARATUS, AND IMAGE FORMING APPARATUS

BACKGROUND OF THE INVENTION

Field of the Invention

The present invention relates to a sheet stacking apparatus and an image forming apparatus including the sheet stacking apparatus.

Description of the Related Art

Sheet processing apparatuses that are provided with a function of aligning end portions of sheets are disclosed in Japanese Patent Laid-Open No. 2014-19569 and Japanese Patent Laid-Open No. 2007-290861. In the above, two edge portions of the discharged sheets in the width direction are matched by a pair of aligning members while being supported by the pair of aligning members, and by moving the aligning members in directions that distance away the aligning members from each other, the matched sheets are dropped down on a loading tray disposed below the aligning member in the vertical direction.

However, the above configuration has a problem in that the user is unable to easily access the sheet on the loading tray due to the presence of the aligning member.

SUMMARY OF THE INVENTION

In accordance with a first aspect of the present invention, a sheet stacking apparatus includes a conveying unit configured to convey a sheet, a first support member configured to support the sheet conveyed by the conveying unit, the first support member including a first supporting surface contacting an underside, in a vertical direction, of a first end portion of the sheet in a direction orthogonal to a sheet conveying direction, a second support member configured to support the sheet conveyed by the conveying unit, the second support member including a second supporting surface contacting an underside, in a vertical direction, of a second end portion of the sheet in the direction orthogonal to the sheet conveying direction, and a stacking unit on which the sheet is stacked. At least one of the first support member and the second support member is capable of moving between a first position that supports the sheet so that the sheet does not drop down to the stacking unit and a second position that does not support the sheet such that the sheet drops down onto the stacking unit, and a length of the first support member is shorter than a length of the second support member in the sheet, conveying direction.

In accordance with a second aspect of the present invention, an image forming apparatus that forms an image on a sheet includes an image forming unit configured to form the image on the sheet, a conveying unit configured to convey the sheet on which the image has been formed, the conveying unit conveying a sheet in a direction in which a width direction of the sheet is paralleled with a front-rear direction of the apparatus, and a pair of aligning members configured to align the sheet conveyed by the conveying unit, the pair of aligning members including a first aligning member that faces a first end surface close to the front of the apparatus, and a second aligning member that faces a second end surface of the sheet opposite to the first end surface of the sheet in the width direction of the sheet. A length of the first aligning member is shorter than a length of the second aligning member in the conveying direction.

Further features of the present invention will become apparent from the following description of exemplary embodiments with reference to the attached drawings.

BRIEF DESCRIPTION OF THE DRAWINGS

FIG. 1.3 is a block diagram of the image forming system according to the first exemplary embodiment.

DESCRIPTION OF THE EMBODIMENTS

Figure 1:
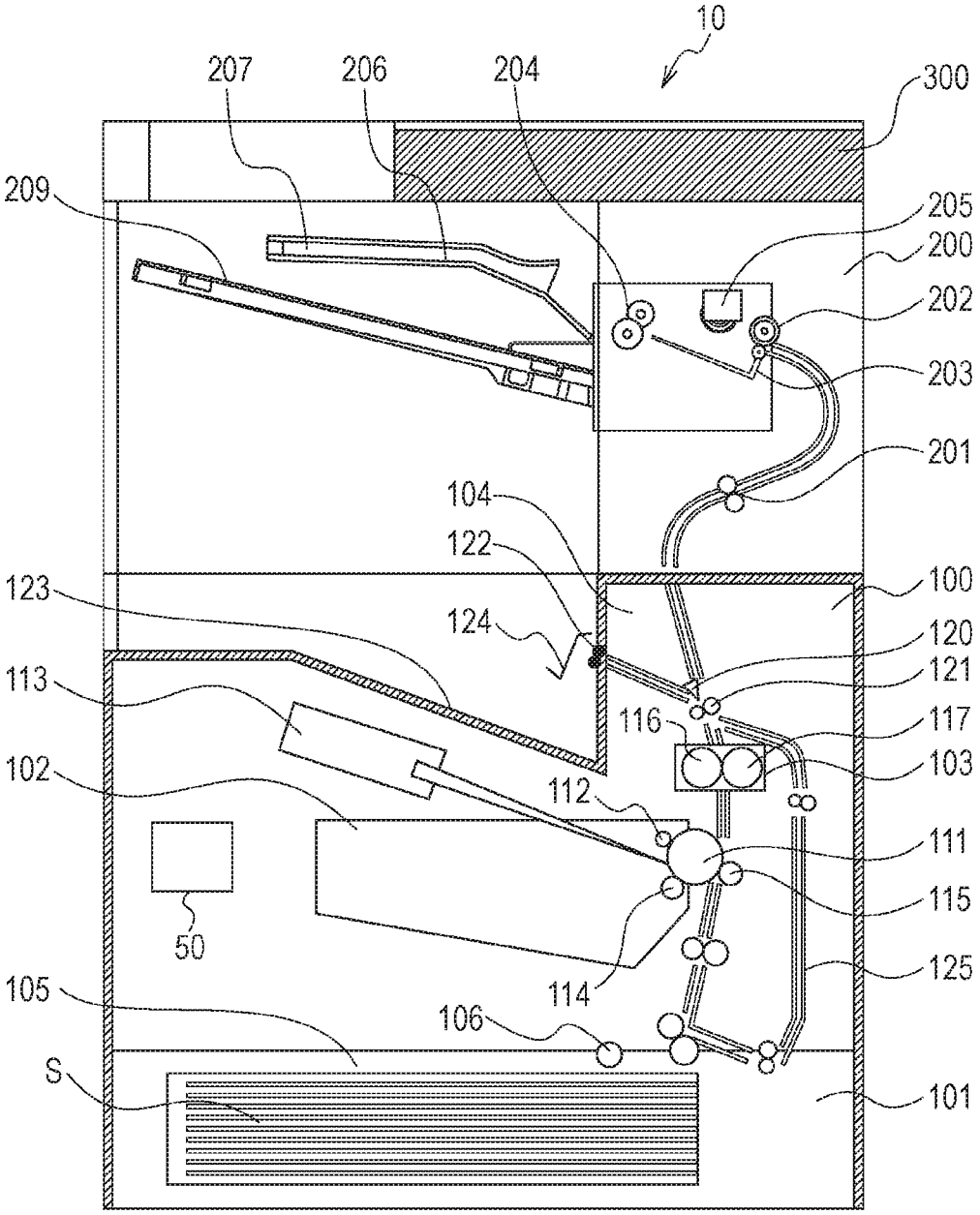
FIG. 1 is a schematic block diagram of an image forming system according to a first exemplary embodiment.

Hereinafter, referring to the drawings, the best mode for carrying out the disclosure will be exemplified in detail. Note that the dimensions, the materials, and the shapes of the components, the relative configuration of the components, and the like that are described in the following exemplary embodiments are to be appropriately altered based on the configuration of the device to which the present disclosure is applied and on various conditions, and the scope of the present disclosure is not intended to be limited by the following exemplary embodiments.

First Exemplary Embodiment

Figure 13:
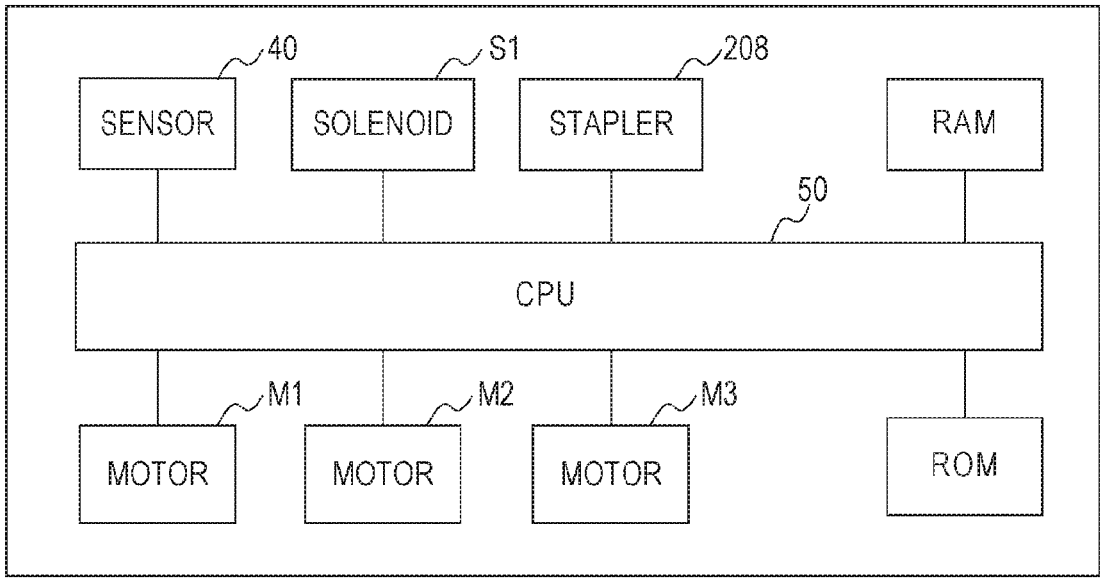

FIG. 1 is a diagram illustrating a schematic configuration of an image forming apparatus according to a first exemplary embodiment of the present disclosure. Referring to FIG. 1, reference numeral 10 is an image forming system, and reference numeral 100 is the image forming apparatus (a printer) including an image forming unit 102. A sheet processing apparatus 200 that performs processes such as stapling on a sheet S on which an image has been formed with the image forming unit 102 is detachably attached to the image forming apparatus 100. Furthermore, the image forming apparatus 100 has an image reading apparatus 300, which reads out an original image, attached on the sheet processing apparatus 200. FIG. 13 is a block diagram of the image forming apparatus of the first exemplary embodiment.

As illustrated in FIG. 1, the image forming apparatus 100 includes the image forming unit 102, a sheet feed unit 101 that feeds a sheet to the image forming unit 102, a fixing unit 103, a sheet discharge unit 104, and a CPU (a control member) 50.

The image forming unit 102 includes a photosensitive drum 111 that rotates counterclockwise, an exposure device 113, and a charge roller 112, a developing device 114, and a transfer roller 115, which are disposed in order in a rotation direction of the photosensitive drum 111. The image forming unit 102 forms an image on the sheet S with an image forming process performed by the above pieces of process equipment. Furthermore, the sheet feed unit 101 includes a cassette 105 in which a plurality of sheet S that are fed to the image forming unit 102 are contained in a mounted state, and a sheet feeding roller 106. The fixing unit 103 includes a fixing roller 116, and a pressure roller 117 that abuts against the fixing roller 116.

Furthermore, the sheet discharge unit 104 includes a switching flapper (a switching member) 120 that switches the conveyance path of the sheet S, a conveyance roller pair 121 capable of forward and reverse rotation, a discharge roller pair 122, a discharged sheet stacking unit 123 formed on an upper surface of the image forming apparatus 100, and a full load detection flag 124. Note that the switching flapper 120 is capable of moving between a position that conveys the sheet S on which an image has been formed towards the sheet processing apparatus 200 and a position that conveys the sheet S towards the discharge roller pair 122. The CPU 50 moves the switching flapper 120 by controlling a solenoid (a drive member) S1.

Description of an image forming operation and a sheet processing operation performed by the image forming system 10 will be given next. Image information is transmitted to the image forming apparatus 100 from a computer (not shown) or through a network, such as a LAN, first. Furthermore, image information that has been read out by the image reading apparatus 300 is transmitted to the image forming apparatus 100. The exposure device 113 emits a laser beam according to the above pieces of image information and exposes a surface of the photosensitive drum 111 that is uniformly charged to a predetermined polarity and potential with a charge roller 112. With the above, the electric charge is removed from the exposed portion of the surface of the photosensitive drum 111 and an electrostatic latent image is formed on the surface of the photosensitive drum 111. Furthermore, a toner is adhered to the electrostatic latent image with the developing device 114 such that electrostatic latent image is developed as a toner image. The rotation of the photosensitive drum 111 in the counterclockwise direction conveys the toner image formed on the photosensitive drum 111 in the above manner to a transfer nip portion between the photosensitive drum 111 and the transfer roller 115.

Meanwhile, the sheets S contained in the cassette 105 are separated sheet by sheet by the sheet feeding roller 106 and are supplied towards the image forming unit 102. Subsequently, the sheet S is supplied to the transfer nip portion at a timing aligning the toner image formed on the image forming unit 102. With the above, the toner image on the photosensitive drum 111 is transferred onto the sheet S with the transfer roller 115. Subsequently, the sheet S on which the toner image has been transferred from the photosensitive drum 111 in the above manner is conveyed to the fixing unit 103. The sheet S that has been conveyed to the fixing unit 103 is nipped and conveyed at the fixing nip portion formed between the fixing roller 116 and the pressure roller 117. The sheet S is heated and compressed at the above timing, and the toner image is fixed to the surface of the sheet S.

Note that in a case in which no process is required to be performed on the sheet S, the switching flapper 120 is disposed at the position conveying the sheet S towards the discharge roller pair 122. With the above, the sheet S to which the toner image has been fixed is conveyed with the conveyance roller pair 121 along a sheet discharge guide and is discharged on the discharged sheet stacking unit 123 in a face down state (in a state in which the surface on which the toner image is formed is faced downwards) with the discharge roller pair 122. Note that the full load detection flag 124 that detects the sheets S at full load and a sensor 40 that detects the full load detection flag 124 are provided above the discharged sheet stacking unit 123. When the discharged sheets S are detected to be at full load by the full load detection flag 124 and the sensor 40, the CPU 50 does not allow the image forming apparatus 100 to form an image until the sheets S on the sheet discharge tray is removed.

Furthermore, the image forming apparatus 100 includes a resupplying path 125 of the sheet S that is used when forming an image on both the front surface and the back surface of the sheet S. When a mode that forms an image on both surfaces of the sheet S is set, after the back end of the sheet S on which a toner image has been fixed on one side (the front side) passes through the conveyance roller pair 121, the sheet S is switched back and is conveyed to the resupplying path 125. Subsequently, an image is formed on the back surface of the sheet S as well by having the sheet S pass through the image forming unit 102 and the fixing unit 103 once again.

Meanwhile, when set to perform a process, such as stapling the sheets S on which the images have been formed, is set, the CPU 50 controls the solenoid S1 and positions the switching flapper 120 at a position that makes the sheet S move towards the sheet processing apparatus 200.

Figure 2:
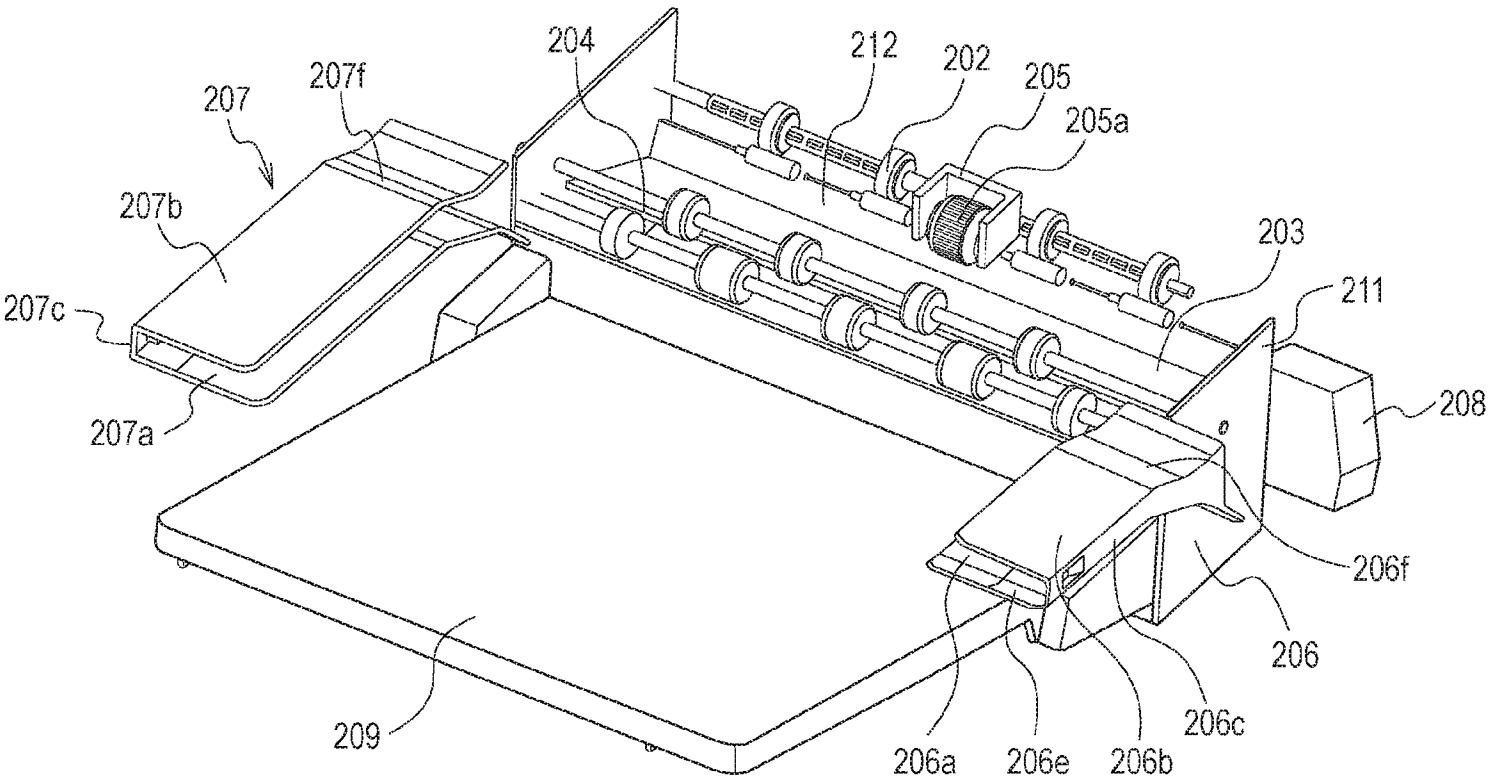
FIG. 2 is a perspective view of a sheet processing apparatus according to the first exemplary embodiment.

Referring to FIGS. 1 and 2, description of the sheet processing apparatus 200 will be given next. FIG. 2 is a perspective view of the sheet processing apparatus 200 viewed from the upper side in the sheet discharge direction. The sheet processing apparatus 200 includes a first conveyance roller pair 201 and an intermediate stacking unit 203 for temporarily placing and aligning the sheets that has been conveyed with a second conveyance roller pair (a conveying unit) 202. The sheet processing apparatus 200 further includes a discharge roller pair 204 that is capable of coming in contact, with each other and being separated from each other, and a back end aligning member 205 that performs aligning of the back ends of the sheet S, which have been conveyed to the intermediate stacking unit 203, in the conveying direction. Note that as illustrated in FIG. 2, the discharge roller pair 204 includes upper rollers and lower rollers that are disposed at different positions in the width direction.

Furthermore, the sheet processing apparatus 200 includes a first aligning member (a first support member) 206 that performs aligning in the width direction that is orthogonal to the conveying direction of the sheet S, and a second aligning member (a second support member) 207. The first aligning member 206 is provided on one side in the width direction and the second aligning member 207 is provided on the other side in the width direction. When the image forming apparatus 100 is viewed from the front, the first aligning member 206 is provided on the side (the front side) that is near to the front, and the second aligning member 207 is provided on the side (the rear side) that is far from the front. Herein, the front of the image forming apparatus 100 is the side (the side on which a user operation unit, such as an operation panel, is provided) which the user accesses the image forming apparatus 100. Furthermore, the sheet processing apparatus 200 includes a stapler (a processing member) 208 that staples the bundle of sheets (a plurality of sheets S) that have been matched, and a loading tray (a stacking unit) 209 for stacking the sheet S thereon.

As illustrated in FIG. 2, the first aligning member 206 and the second aligning member 207 include supporting surfaces (undersides) 206*a* and 207*a*, respectively, for supporting the underside of the sheet S, and upper surfaces 206*b* and 207*b*, respectively, for preventing the end portion of the sheet S from curling up such as by curling. The upper surfaces 206*b* and 207*b* face the supporting surfaces (undersides) 206*a* and 207*a*, and the upper surfaces 206*b* and 207*b* have shapes that are substantially parallel to the supporting surfaces (undersides) 206*a* and 207*a*. Furthermore, the first aligning member 206 and the second aligning member 207 have vertical portions 206*c* and 207*c*, respectively, in which the vertical portion 206*c* connect the supporting surface (underside) 206*a* and the upper surface 206*b* to each other and in which the vertical portion 207*c* connects the supporting surface (underside) 207*a* and the upper surface 207*b* to each other. The first aligning member 206 and the second aligning member 207 are each configured so as to have a U-shaped cross-section.

Furthermore, the upper surfaces 206*b* and 207*b* of the first aligning member 206 and the second aligning member 207 are bent from inflection points 206*f* and 207*f*. Furthermore, viewing in the rotational axis direction of the second conveyance roller pair 202, a nip line (a line that is orthogonal to a line connecting the center of the rollers) of the second conveyance roller pair 202 extends towards the upper surface 206*b* (the nip line and the upper surface 206*b* intersect). With the above, the sheet S that has become deformed due to curling and the like can be forcibly stiffened and the first aligning member 206 and the second aligning member 207 can improve the aligning performance of the sheets S.

Furthermore, the sheet processing apparatus 200 includes an aligning reference wall (width-direction reference portion) 211 that abuts against the lateral edges of the sheets S and that serves as an aligning reference when performing aligning in the width direction, and an aligning reference wall (conveying-direction reference portion) 212 that abuts against the back ends of the sheets S and that serves as an aligning reference when performing aligning in the conveying direction. The main components of the sheet processing apparatus 200 have been described above.

Figure 3:
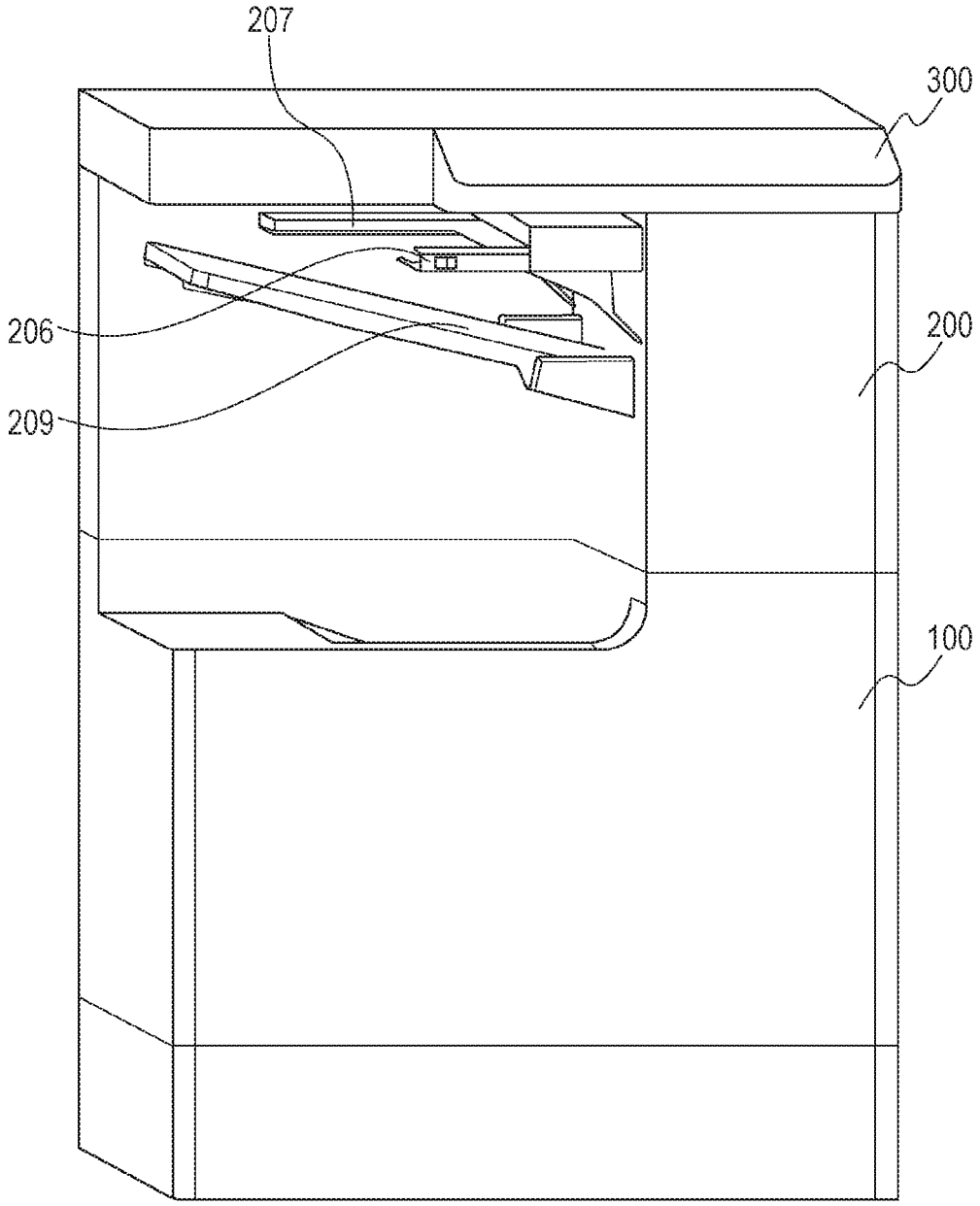
FIG. 3 is a perspective view of the image forming system according to the first exemplary embodiment.
Figure 4:
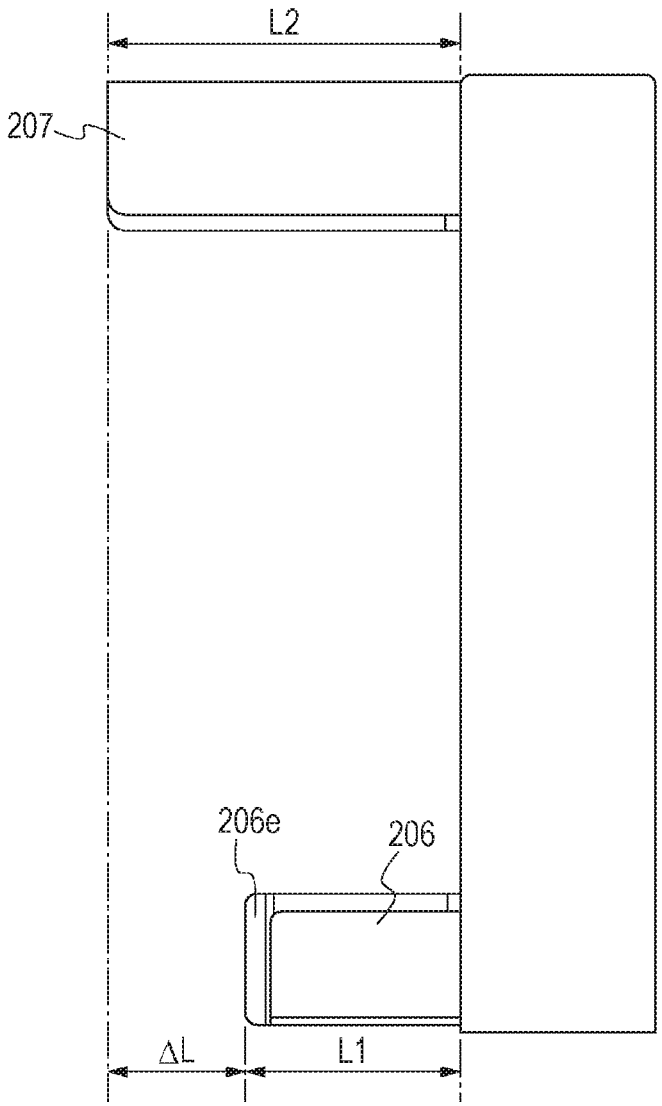
FIG. 4 is a top view of first and second aligning members according to the first exemplary embodiment.
Figure 5A:
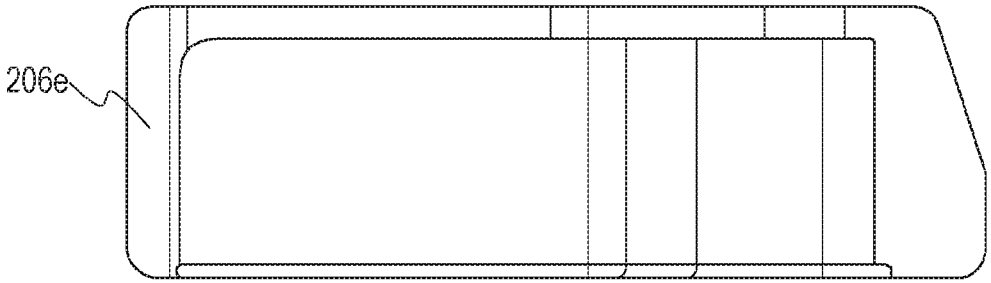
FIG. 5A is a top view and FIG. 5B is a front view of the first aligning member according to the first exemplary embodiment.
Figure 5B:
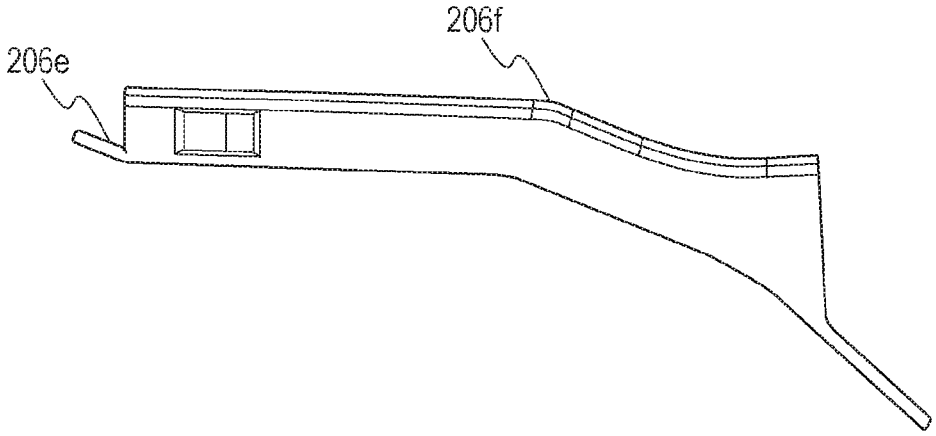

Referring to FIGS. 3, 4, 5A, and 5B, the first aligning member 206 and the second aligning member 207 will be described next. FIG. 3 is a perspective view of the image forming system 10. FIG. 4 is a diagram of the first aligning member 206 and the second aligning member 207 viewed from above. FIG. 5A is a diagram of the first aligning member 206 viewed from above, and FIG. 5B is a diagram of the first aligning member 206 viewed in the width direction. As illustrated in FIG. 4, the length of the first aligning member 206 and that of the second aligning member 207 are different in the conveying direction of the sheet S. Furthermore, as illustrated in FIG. 3, the length of the first aligning member 206 that is disposed on the side (the front side), which the user taking out the sheet accesses, is shorter than the length of the second aligning member 207 in the conveying direction. In FIG. 4, the length (L2) of the second aligning member 207 is 220 mm and the length (L1) of the first aligning member 206 is 160 mm; accordingly, the difference in length is 60 mm (ΔL). Furthermore, the first aligning member 206 is provided at a position facing the upstream side of the second aligning member 207 in the conveying direction of the sheet S and is not provided at a position facing the downstream side thereof. Furthermore, as illustrated in FIG. 5B, an inclination portion (and inclination area) 206*e* that is inclined upwards in the vertical direction towards the downstream side from the upstream side and that lifts the sheet S upwards in the vertical direction is provided at a downstream end of the first aligning member 206, which is a portion of the supporting surface 206*a* on the downstream side. Note that in the present exemplary embodiment, the side that the user accesses is the upstream side in the direction in which the cassette 105 is drawn out from the image forming apparatus 100. Note that from the viewpoint of usability, the difference (ΔL) between the length (L2) of the second aligning member 207 and the length (L1) of the first aligning member 206 is preferably 40 to 80 mm. Furthermore, when the ratio (L1/L2) of the length of the first aligning member 206 to the length of the second aligning member 207 is excessively large, usability is degraded, and when excessively small, it will be difficult to support the sheet S. Accordingly the ratio (L1/L2) is preferably 0.5 to 0.8.

Figure 6:
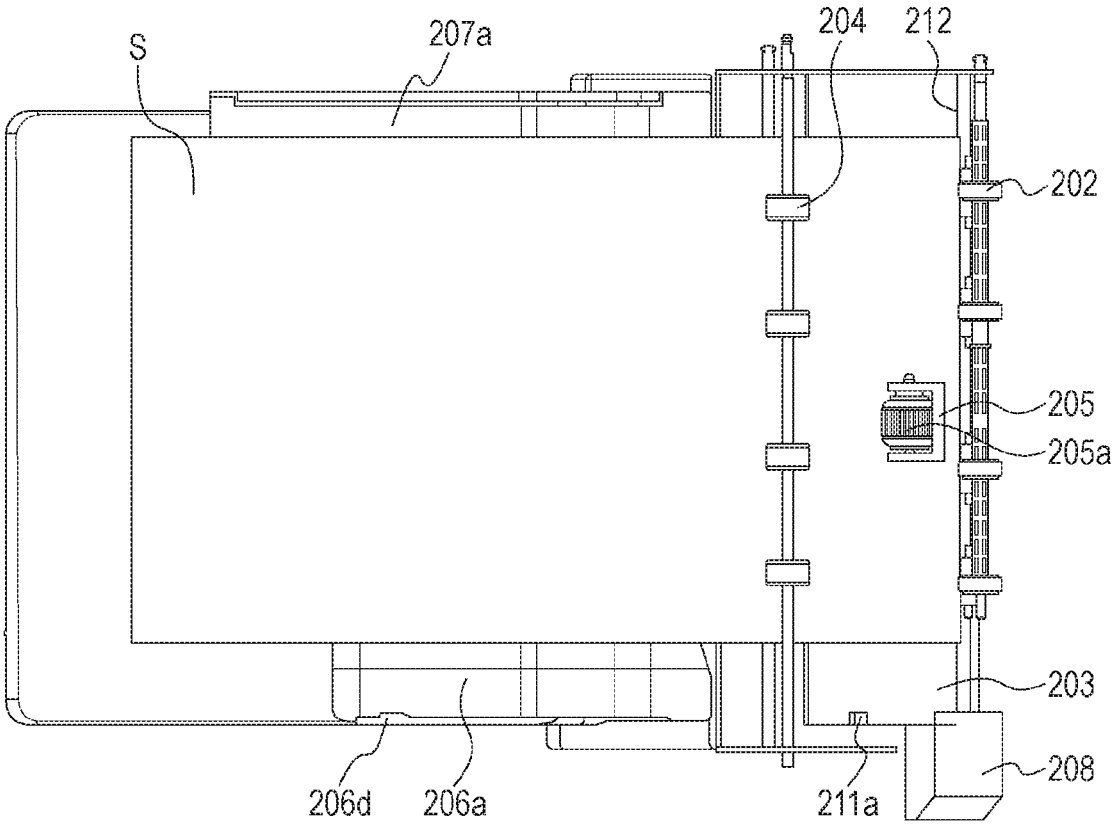
FIG. 6 is a top view of the sheet processing apparatus at the start of sheet aligning according to the first exemplary embodiment.

A sequential operation of the sheet processing apparatus 200 when performing a process on the sheet S will be described next. FIG. 6 is a diagram viewing the sheet processing apparatus 200 from above and illustrates the positional relationship between each component when receiving the sheet S in the intermediate stacking unit 203. Note that in FIG. 6, in order to make the position of the sheet S visible, the upper surfaces 206*b* and 207*b* are not shown in the figure.

The sheet S is conveyed to the position in FIG. 6 with the second conveyance roller pair 202. Note that in FIG. 6, the size of the sheet S is assumed to be an LGL size, for example. By controlling an actuator (a moving member) including a motor M1, the CPU 50 positions the first aligning member 206 and the second aligning member 207 at a position (a first position) that enables the underside of the sheet S to be supported by the supporting surfaces 206*a* and 207*a* supporting the sheet S in the width direction (the up-down direction in FIG. 6). In the above, an aligning reference 211*a* that is a portion of the aligning reference wall, and an aligning reference wall (a first reference portion) 206*d* of the first aligning member 206 are positioned (on the same plane) so that each of the positions in the width direction is the same in the conveying direction.

Figure 7:
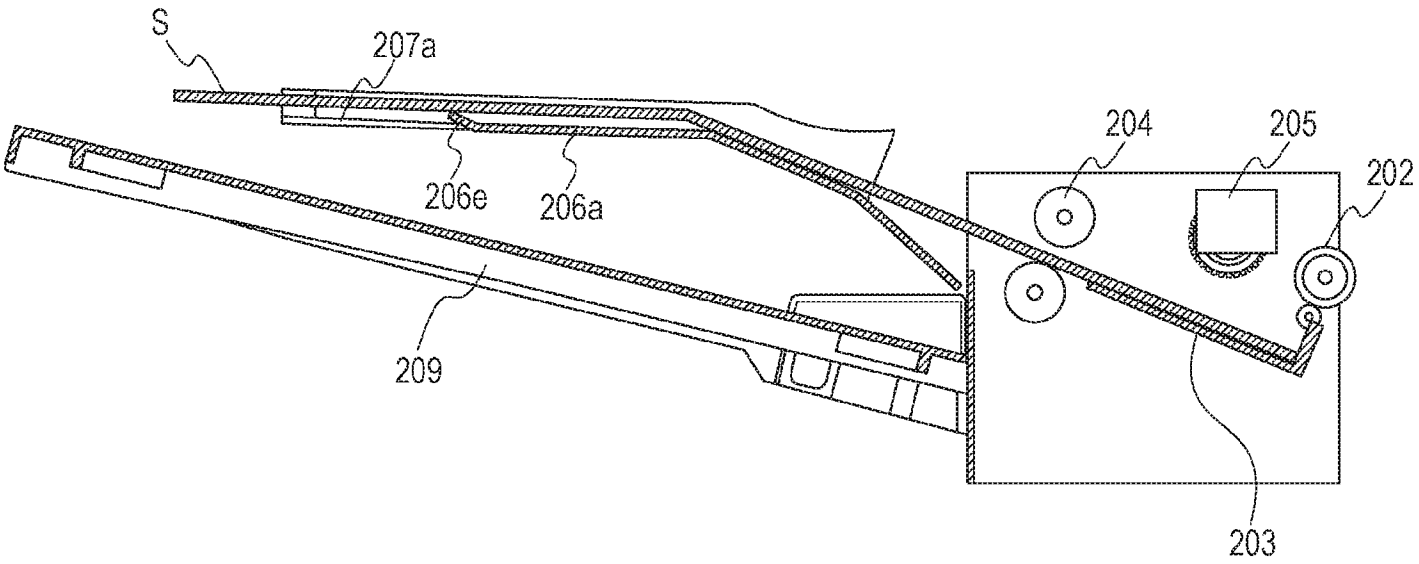
FIG. 7 is a cross-sectional view of the sheet processing apparatus according to the first exemplary embodiment viewed from the front.

FIG. 7 is a schematic cross-sectional view illustrating a state in which the supporting surface 206*a* and the inclination portion 206*e* of the first aligning member 206, and the supporting surface 207*a* of the second aligning member 207 are supporting the LGL-sized sheet S. Even if the length of the first aligning member 206 in the conveying direction is shorter than the length of the second aligning member 207 in the conveying direction, since the first aligning member 206 includes the inclination portion 206*e* downstream of the supporting surface 206*a*, the sheet S does not drape downwards towards the loading tray 209 and can be supported.

Furthermore, when supporting the sheet S on the first aligning member 206 and the second aligning member 207, the CPU 50 controls a motor M3 to separate the discharge roller pair 204 from each other and convey the sheet S to the first aligning member 206 and the second aligning member 207 with the second conveyance roller pair 202. The underside of the conveyed sheet S is supported by the intermediate stacking unit 203, the supporting surfaces 206*a* and 207*a*, and the inclination portion 206*e*.

When the back end of the sheet S is discharged from the second conveyance roller pair 202 and is placed on the intermediate stacking unit 203, the CPU 50 starts the aligning operation of the sheet S by controlling the actuator. The CPU 50 moves the second aligning member 207 towards the inner side (the direction approaching the first aligning member 206) in the width direction so that the vertical portion (an aligning surface) 207*c* presses the lateral edge portions of the sheets S; accordingly, the sheets S are moved towards the aligning reference wall 206*d* and the aligning reference 211*a*. With the above, the sheets S are matched, and since the sheets S become closer to the side that the user accesses, the user accessibility (manipulability) is improved.

Figure 8:
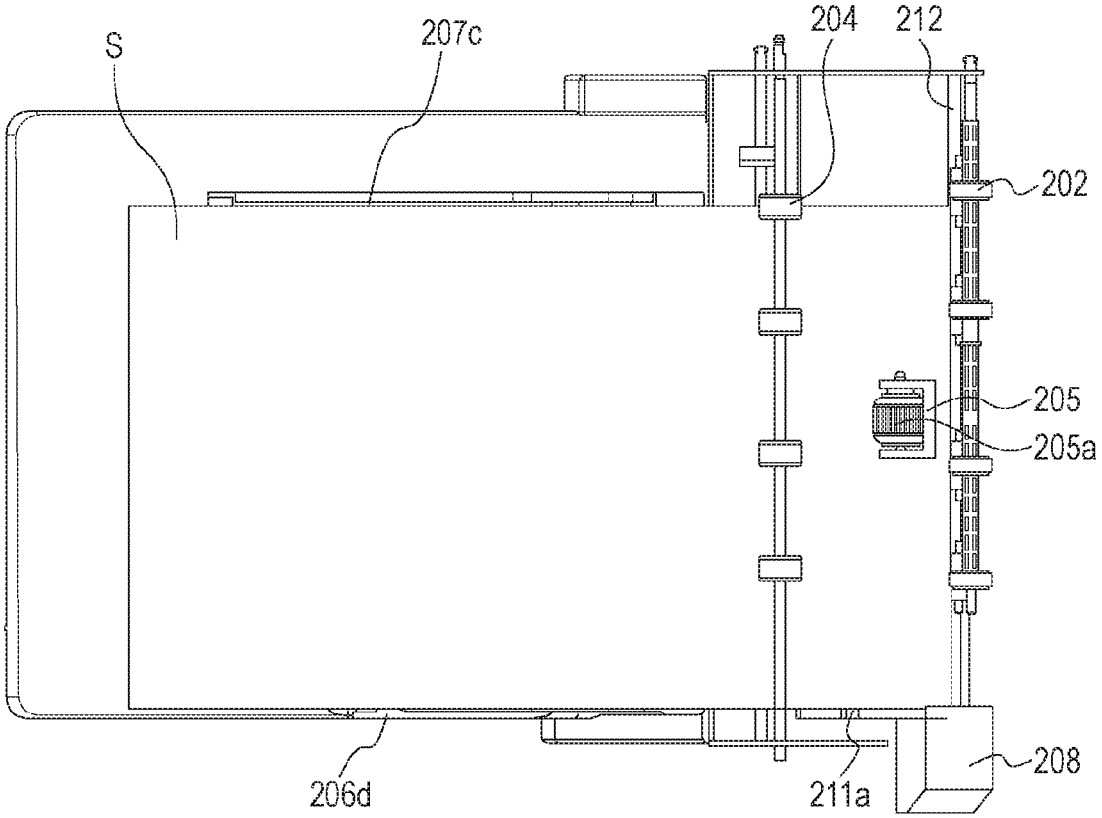
FIG. 8 is a top view of the sheet processing apparatus at completion of the sheet aligning according to the first exemplary embodiment.

FIG. 8 illustrates the positional relationship between the elements of the sheet processing apparatus 200 at the point when the aligning of the sheet S has been completed in the width direction. After completion of the aligning in the width direction, the CPU 50 starts aligning in the conveying direction with the back end aligning member 205. The back end aligning member 205 is configured so as to be capable of moving between a separated position and an abutted position with respect to the sheets S subject to aligning. By controlling another actuator including a motor M2, the CPU 50 moves the back end aligning member 205.

The back end aligning member 205 includes a friction member (a rubber roller, for example) 205*a* serving as a contact surface against the sheet S. With the another actuator, the CPU 50 rotates the friction member 205*a* to the upstream side (a direction moving the sheet S towards the aligning reference wall 212) in the conveying direction while the friction member 205*a* is abutted against the upper surface of the sheet S to perform aligning of the sheet S in the conveying direction. When the aligning operation of the sheet S in the conveying direction is completed and before the succeeding sheet S reaches the intermediate stacking unit 203, the back end aligning member 205 retracts, once more, to the position (the separated position) that does not interrupt the conveyance of the sheet S. Furthermore, the second aligning member 207 retracts as well to a sheet receiving position (a position in FIG. 6), which is a retraction to the outside in the width direction from an aligning position (a position in FIG. 8), before the succeeding sheet S reaches the intermediate stacking unit 203.

Furthermore, the sheet processing apparatus 200 includes, near the aligning reference wall 211, a holding member (not shown) that is provided so as to be capable of coming in contact with and being separated from the matched sheets S and that holds the sheets S from a substantially top surface direction. The holding member holds the bundle of sheets S by applying pressure to (abutting against) the bundle of sheets S from above so that the sheets S on which an aligning process has been performed does not become disarranged once again. Furthermore, when aligning a new bundle of sheets S, the holding member retracts to a position that does not interrupt the aligning of the sheets S, and when the operation of aligning the sheets S is completed, the holding member applies pressure to and holds the sheets S once again.

The aligning operation in the width direction and that in the conveying direction described above are performed each time a sheet S is conveyed. Then, when the operation of aligning a predetermined number of sheets S is completed, the predetermined number of sheets S (the bundle of sheets) are stapled with the stapler 208. Subsequently, the CPU 50 controls the actuator and moves the first aligning member 206 and the second aligning member 207 so as to distance away the first aligning member 206 and the second aligning member 207 from each other to a position (a second position) that does not support the sheet S, and makes the separated discharge roller pair 204 nip the sheet S and rotates the discharge roller pair 204. In other words, while conveying the sheet S with the discharge roller pair 204, the first aligning member 206 and the second aligning member 207 are moved in the width direction. With the above, the bundle of sheets S that have been supported by the first aligning member 206 and the second aligning member 207 drop down and are placed on the loading tray 209.

Note that the image forming system 10 may discharge the sheets S on which no stapling is performed from the sheet processing apparatus 200. In such a case, the conveying path is switched with the switching flapper 120 and the sheets S that have been conveyed from the image forming apparatus 100 are conveyed to the sheet processing apparatus 200 with the first conveyance roller pair 201. Subsequently, the sheets S are conveyed to the intermediate stacking unit 203 with the second conveyance roller pair 202. In the above case, the discharge roller pair 204 are performing nipping (are not separated), and the first aligning member 206 and the second aligning member 207 are positioned at a retraction position (a position after moving to the outside in the width direction) where the sheets S are not supported. Subsequently, by nipping and conveying the sheet S that has been conveyed with the discharge roller pair 204, the sheet S is directly conveyed (discharged) to the loading tray 209 without being temporarily accumulated in the intermediate stacking unit 203.

Second Exemplary Embodiment

Figure 9:
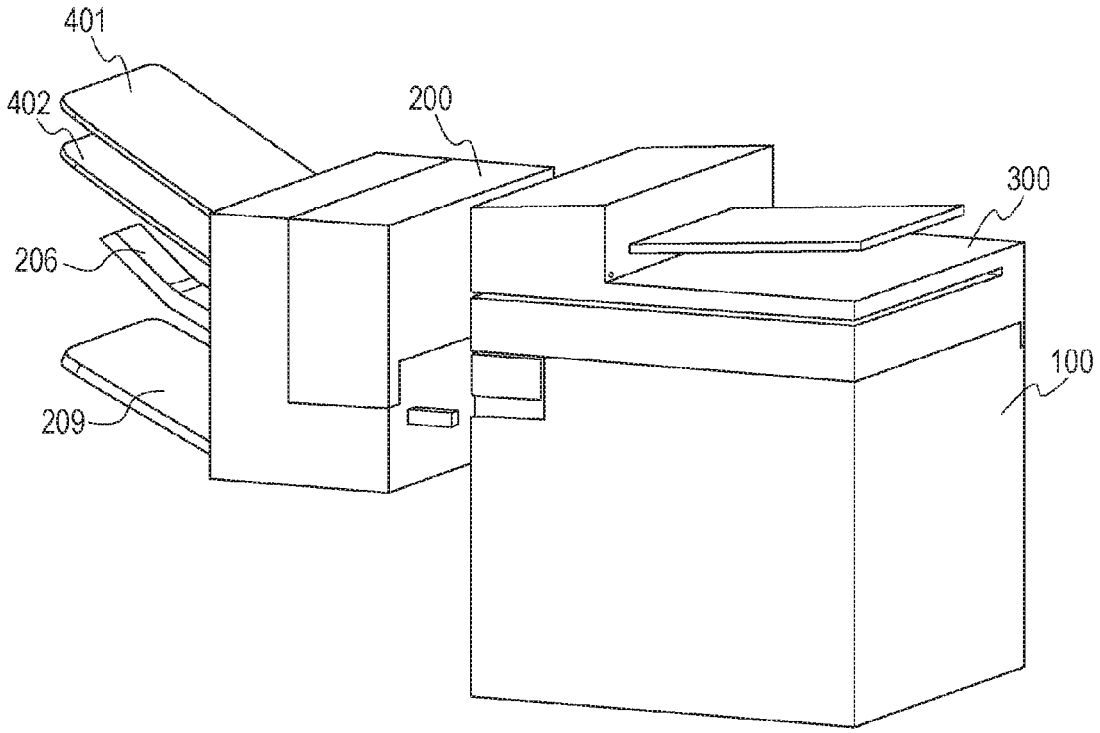
FIG. 9 is a perspective view of an image forming system according to a second exemplary embodiment.
Figure 10:
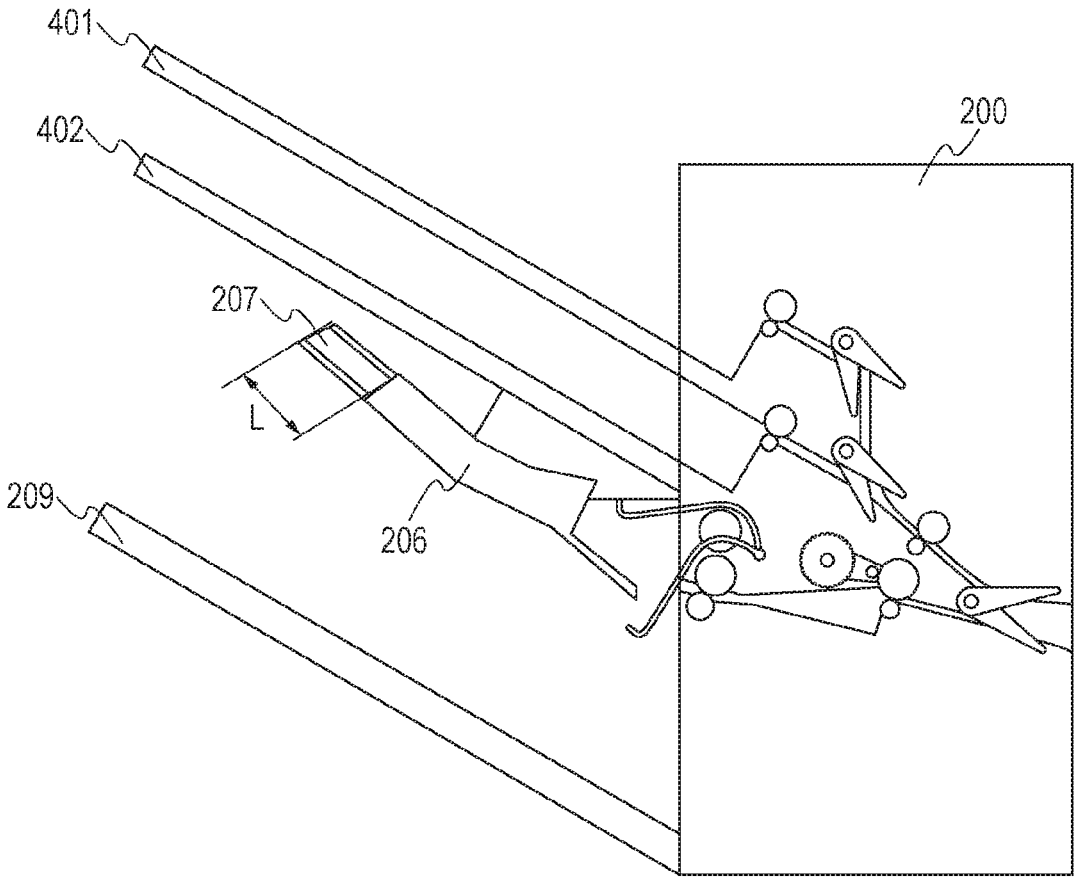
FIG. 10 is a cross-sectional view of a sheet processing apparatus according to the second exemplary embodiment viewed from the front.

Description of a second exemplary embodiment will be given next with reference to FIGS. 9 and 10. In the following description of the second exemplary embodiment, description of the configurations and the operations common to those of the first exemplary embodiment will be omitted as appropriate. FIG. 9 is a perspective view of an image forming system according to the second exemplary embodiment, and FIG. 10 is a schematic cross-sectional view of a sheet processing apparatus 200 according to the second exemplary embodiment.

As illustrated in FIG. 9, in the image forming system of the second exemplary embodiment, the image reading apparatus 300 is attached to the upper portion of the image forming apparatus 100, and the sheet processing apparatus 200 is attached to a side of the image forming apparatus 100. Furthermore, as illustrated in FIG. 10, the sheet processing apparatus 200 includes a plurality of sheet loading trays 401 and 402 above the pair of aligning members 206 and 207.

In the configuration of the second exemplary embodiment as well, a length of the first aligning member 206, which is on the side which the user accesses, is shorter than the length of the second aligning member 207 in the conveying direction by a length L. Accordingly, in the second exemplary embodiment as well in which the plurality of sheet loading trays 409 and 410 are disposed above the pair of aligning members 206 and 207, the accessibility of the user to the loading tray can be improved.

Note that in the first exemplary embodiment, the actuator, with a single motor M1, moves the first aligning member 206 and the second aligning member 207 between the position where the sheet S is supported and the position where the sheet S is not supported by interlocking the first aligning member 206 and the second aligning member 207 to each other. More specifically, in the first exemplary embodiment, when the first aligning member 206 moves inward in the width direction, the second aligning member 207 moves inward in the width direction as well, and when the first aligning member 206 moves outward in the width direction, the second aligning member 207 moves outward in the width direction as well. However, the present disclosure is not to be limited by the above configuration, and the present disclosure may be configured such that either one of the first aligning member 206 and the second aligning member 207 is moved by the actuator. Note that in the first exemplary embodiment, when performing the aligning operation of the sheets S in the width direction, the first aligning member 206 that is the reference side is fixed and the second aligning member 207 is moved. Concerning such a configuration, a configuration such as the one in Japanese Patent No. 4109900, for example, may be used.

Modification

Figure 11:
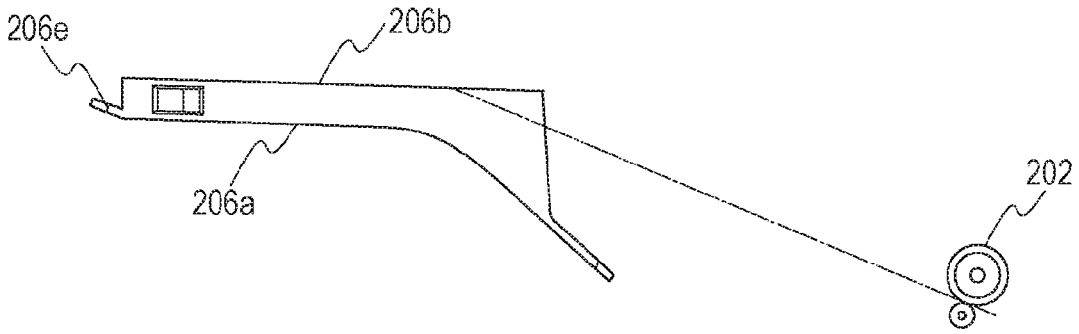
FIG. 11 is a front view of a first aligning member and a conveyance roller pair according to a modification.

FIG. 11 is a front view illustrating a modification of the first aligning member 206 of the first exemplary embodiment. As illustrated in FIG. 11, the shape of the upper surface 206*b* of the first aligning member 206 may be straight.

Figure 12:
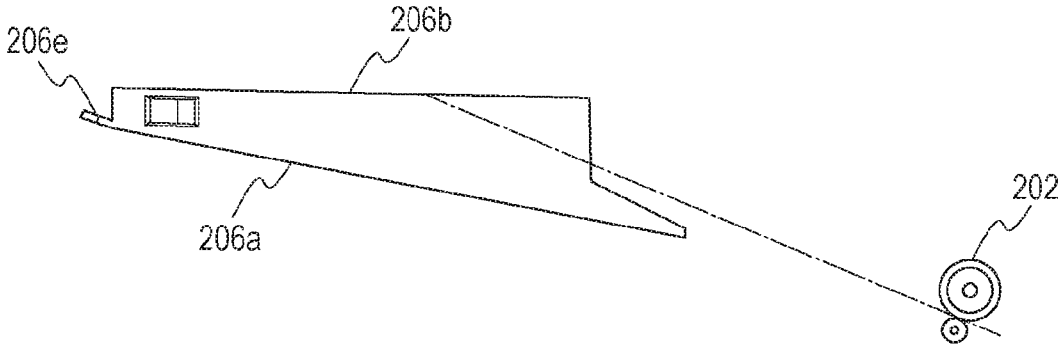
FIG. 12 is a front view of a first aligning member and a conveyance roller pair according to a modification.

Furthermore, FIG. 12 is a front view illustrating another modification of the first aligning member 206 of the first exemplary embodiment. As illustrated in FIG. 12, the shape of the upper surface 206*b* of the first aligning member 206 may be straight, and the shape of the supporting surface 206*a* may be straight as well. In other words, in the configuration of the modification described above as well, similar to that of the first exemplary embodiment, when viewed in the rotational axis direction of the second conveyance roller pair 202, a nip line (a line that is orthogonal to a line connecting the center of the rollers) of the second conveyance roller pair 202 extends towards the upper surface 206*b* (the nip line and the upper surface 206*b* intersect).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-085303, filed Apr. 17, 2015, which is hereby incorporated by reference herein in its entirety.

What is claimed is:

1. A sheet stacking apparatus, comprising:

a conveying unit configured to convey a sheet;

a first support member configured to support the sheet conveyed by the conveying unit, the first support member including a first supporting surface contacting an underside, in a vertical direction, of a first end of the sheet in a direction orthogonal to a sheet conveying direction;

a second support member configured to support the sheet conveyed by the conveying unit, the second support member including a second supporting surface contacting an underside, in a vertical direction, of a second end of the sheet in the direction orthogonal to the sheet conveying direction; and a stacking portion on which the sheet is stacked, wherein at least one of the first support member and the second support member is capable of moving between a first position that supports the sheet so that the sheet does not drop down to the stacking portion and a second position that does not support the sheet such that the sheet drops down onto the stacking portion, and wherein a length of the first support member is shorter than a length of the second support member in the sheet conveying direction, and a longitudinal downstream end portion of the first support member is provided upstream of a longitudinal downstream end portion of the second support member in the sheet conveying direction.

2. The sheet stacking apparatus according to claim 1, wherein the first support member and the second support member include a first aligning surface and a second aligning surface, respectively, that face the first end and the second end of the sheet, respectively, and wherein when the first support member and the second support member are provided at the first position, the first aligning surface and the second aligning surface contact the first end and the second end of the sheet, respectively, so that the sheet is aligned.

3. The sheet stacking apparatus according to claim 2, further comprising a sheet processing unit configured to process the sheet that has been aligned by the first support member and the second support member.

4. The sheet stacking apparatus according to claim 1, wherein the second support member includes a second restriction surface that faces the second supporting surface.

5. The sheet stacking apparatus according to claim 1, wherein the second supporting surface includes an area inclined upwards in the vertical direction from an upstream side towards a downstream side in the conveying direction.

6. The sheet stacking apparatus according to claim 1, further comprising: a moving member configured to move the first support member and the second support member between the first position and the second position.

7. The sheet stacking apparatus according to claim 1, wherein a distance between the stacking portion and the first support member in the vertical direction is shorter as it goes in the sheet conveying direction.

8. The sheet stacking apparatus according to claim 1, wherein the first support member is provided at a position, from which the sheet stacked on the stacking portion is accessed by a user, closer to a side of the apparatus than the second support member.

9. The sheet stacking apparatus according to claim 1, further comprising a moving unit configured to move at least one of the first support member and the second support member.

10. The sheet stacking apparatus according to claim 1, wherein a ratio of a length of the first support member to a length of the second support member is 0.5 to 0.8.

11. The sheet stacking apparatus according to claim 1, a difference between the longitudinal end portion of the second support member and the longitudinal end portion of the first support member in the sheet conveying direction is 40 to 80 mm.

12. An image forming apparatus that forms an image on a sheet, the image forming apparatus comprising:

an image forming unit configured to form the image on the sheet;

a conveying unit configured to convey a sheet;

a supporting unit including:

a first support member configured to support the sheet conveyed by the conveying unit, the first support member including a first supporting surface contacting an underside, in a vertical direction, of a first end of the sheet in a direction orthogonal to a sheet conveying direction;

a second support member configured to support the sheet conveyed by the conveying unit, the second support member including a second supporting surface contacting an underside, in a vertical direction, of a second end of the sheet in the direction orthogonal to the sheet conveying direction; and a stacking portion on which the sheet is stacked, wherein at least one of the first support member and the second support member is capable of moving between a first position that supports the sheet so that the sheet does not drop down to the stacking portion and a second position that does not support the sheet such that the sheet drops down onto the stacking portion, and wherein a length of the first support member is shorter than a length of the second support member in the sheet conveying direction, and a longitudinal downstream end portion of the first support member is provided upstream of a longitudinal downstream end portion of the second support member in the sheet conveying direction.

13. The image forming apparatus according to claim 12, wherein a distance between the stacking portion and the first support member in the vertical direction is shorter as it goes in the sheet conveying direction.

14. The image forming apparatus according to claim 12, wherein the first support member is provided at a position, from which the sheet stacked on the stacking portion is accessed by a user, closer to a side of the apparatus than the second support member.

15. The image forming apparatus according to claim 12, further comprising:

an operation unit through which the apparatus is operated by a user, wherein the first support member is provided at a position closer to the operation unit than the second support member.

16. The image forming apparatus according to claim 12, further comprising a moving unit configured to move at least one of the first support member and the second support member.

17. The image forming apparatus according to claim 12, wherein a ratio of a length of the first support member to a length of the second support member is 0.5 to 0.8.

18. The image forming apparatus according to claim 12, a difference between the longitudinal end portion of the second support member and the longitudinal end portion of the first support member in the sheet conveying direction is 40 to 80 mm.

* * * * *